United States Patent [19]

Tomoff

[11] Patent Number: 4,486,023

[45] Date of Patent: Dec. 4, 1984

[54] EDUCATIONAL GAME DEVICE OF THE COLORED PATTERN TYPE

[76] Inventor: Judith M. Tomoff, 193 Dover, Pontiac, Mich. 48054

[21] Appl. No.: 493,080

[22] Filed: May 9, 1983

[51] Int. Cl.[3] ..... A63B 67/00

[52] U.S. Cl. ..... 273/348; 273/415; 434/98

[58] Field of Search ..... 273/348, 398, 400, 1 G, 273/1 GE, 1 GF, 1 GG, 415, 347, 346, 345, 344; 434/98

[56] References Cited

U.S. PATENT DOCUMENTS

| | | | |
|---|---|---|---|
| 715,249 | 12/1902 | Dunbar | 273/415 X |
| 1,490,201 | 4/1924 | Brown | 273/1 GF |
| 1,542,012 | 6/1925 | Spilman | 273/348 |
| 2,466,805 | 4/1949 | Griffin | 434/98 |
| 3,454,279 | 7/1969 | Foley et al. | 273/1 GE |
| 3,573,869 | 4/1971 | Duckett | 273/409 X |
| 3,674,264 | 7/1972 | Boercker | 273/1 G |
| 3,709,495 | 1/1973 | Krombein | 273/348 X |
| 3,820,789 | 6/1974 | Dudley | 273/400 |
| 3,879,034 | 4/1975 | Petrusek | 273/1 GF |
| 4,210,324 | 7/1980 | Morrison et al. | 273/1 G |

*Primary Examiner*—Paul E. Shapiro

*Attorney, Agent, or Firm*—Harry R. Dumont

[57] ABSTRACT

A game including a plurality of cards each having a different arrangement of colored elements. A plurality of large colored target elements are set out on a flat playing surface such as the floor to duplicate the arrangement of elements on the card that is turned up. The contestant throws a die and thus selects one of the elements as a target. A bean bag is then thrown in one or two tries to hit the individual selected target element. Turns are rotated between contestants until all of the colors are retired. A marker of like color is placed on each one as it is hit.

7 Claims, 7 Drawing Figures

EDUCATIONAL GAME DEVICE OF THE COLORED PATTERN TYPE

FIELD OF THE INVENTION

This invention relates to educational games.

DESCRIPTION OF THE PRIOR ART

In teaching small children, particularly preschoolers and early elementary students, it is important to keep the pupils interested and to hold their attention. Part of the preschool education is to learn the colors. This game teaches colors and reinforces familiarity with colors. In addition to that, it improves physical agility and motor control with just enough physical activity involved to keep the contestants occupied. A number of games of this general type are known in the prior art and are shown for example in U.S. Pat. No. 3,820,789 issued on June 28, 1974 to Juliette T. Dudley for "COLOR CODED POCKETED TARGET PROJECTILES AND SCORING INDICA" and in U.S. Pat. No. 3,573,869 issued on Apr. 6, 1971 to John W. Duckett for "PLAYING DISC WITH TACKY SURFACE".

SUMMARY OF THE INVENTION

The present invention relates to an improved educational toy whose parts are simple to fabricate and to use and capable of ready storage when not in use. The game is versatile and can be used to handle a number of children with each playing in sequence. The game device includes elements which give the child skill in handling colors, cards and dice and also in throwing projectiles at selected targets.

DESCRIPTION OF THE PREFERRED EMBODIMENT

Figure 1:
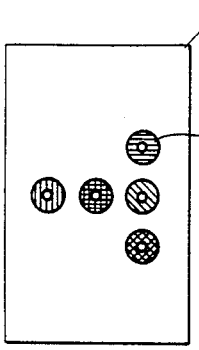
FIGS. 1 and 2 show two of the cards used in the game.
Figure 2:
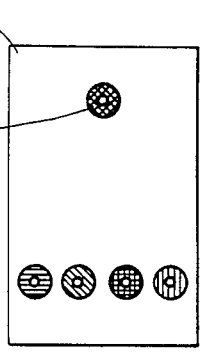
Figure 3:
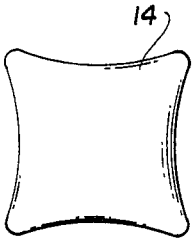
FIG. 3 shows a projectile used.
Figure 4:
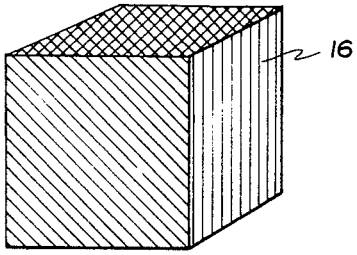
FIG. 4 shows a die used in the game.

The educational game of the invention includes several principal components. One of these is a plurality or a deck of cards 10 two examples of which are shown in FIGS. 1 and 2. Each card 10 bears an arrangement of colored elements 12 which elements are set up in a different pattern on each card. The elements 12 are each of several different colors which typically are orange, yellow, green, blue, and red. It will be seen that the different arrangement and set up of colors helps to reinforce the child's knowledge of colors since it is involved in the first step in the game in which the target elements are set up to conform to the patterns on the cards 10. FIG. 3 shows a projectile used in the game which preferably is embodied as a bean bag 14. The means for selecting the color of each contestant, that is for selecting his target is shown in FIG. 4 as a die 16. Each of the faces of the die 16 has a different color and whichever one falls up determines the contestant's target color.

Figure 5:
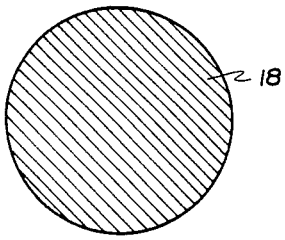
FIG. 5 shows one of the target elements.
Figure 6:
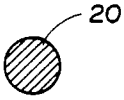
FIG. 6 shows one of the marker discs also used.

The several target elements are preferably of a circular shape to match the color elements 12 on the cards 10 and are identified by the numeral 18 in FIG. 5. These may be fabricated from felt or similar material which is easily handled and arranged on a rug or carpet surface. A marker disc 20 as shown in FIG. 6 is used to place on each of the target elements 18 after it has been hit by a projectile and is retired from the game.

Figure 7:
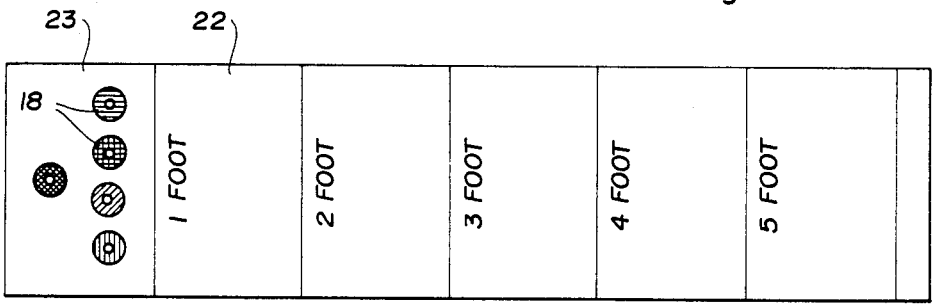
FIG. 7 shows the game set up as it would be used on the floor with a distance marker used to vary the contestants' throw line.

This game is particularly adaptable for use on a flat surface such as the floor and it is possible to include a distance marker sheet as shown in FIG. 7 with the sheet also being of a fabric material. The distance marker 22 has a plurality of spaced markings on it. A portion of the sheet may be laid out as a field 23 of the same shape as the card. As the children gain in their skills, the distance at which they stand can be increased gradually to compensate for their increased skill.

In using the game of this invention, the distance marker 22 is placed flat on the floor. The scorekeeper draws a pattern card 10 from a deck and arranges the large colored target elements 18 on the field 23 in the same arrangement as shown on the card 10 matching both the color and the arrangement of the several colored elements 12. For younger children, the scorekeeper may be a teacher. For elementary students, the contestants themselves may act as scorekeeper. The first player then rolls the die 16 and whichever colored surface comes up first predetermines which color circle or target 18 is his. He then has two tosses of the beanbag 14 from the starter line to hit his selected target element 18. Once he hits the correct target, he places the small marker disc 20 on it and retires it from play. The second player then throws the die 16 to determine which color target 18 is his goal. He likewise has two tosses of the beanbag 14 to hit his goal. The game is then continued until all the colored target elements 18 have been covered. A separate scoring felt may be used at the side to maintain a record of progress of the players. It will be seen that the game is quite versatile and can be varied to handle a number of contestants and the conditions can be changed quite freely. The parts are durable and generally indestructable even by small children.

I claim:

1. An educational game device comprising;

a plurality of cards, each bearing a different arrangement of colored elements;

a plurality of target elements for duplicating said arrangement of colored elements on a separate flat playing surface;

a die having a plurality of colored faces each corresponding to a different one of said element colors for selecting one of said elements as an individual target; and a projectile for hitting the individual selected target elements.

2. The device as set forth in claim 1 in which said colored elements are of circular configuration.

3. The device as set forth in claim 2 in which said target elements are fabricated of circular felt material adapted for use on the floor.

4. The device as set forth in claim 1 in which the projectile comprises a bean bag.

5. The device as set forth in claim 1 further comprising a distance marker to vary the degree of difficulty of the game.

6. The combination as set forth in claim 5 in which a field of a shape like that of the cards is included at the end of the distance marker.

7. The device as set forth in claim 1 in which a marker disc is included for marking each target element as it is hit.

* * * * *